US005089852A

United States Patent [19]

Manno et al.

[11] Patent Number: 5,089,852

[45] Date of Patent: Feb. 18, 1992

[54] NEUTRAL PRESSURE MAGNET ROLL TYPE DEVELOPING UNIT

[75] Inventors: Eugene Manno, Ontario; John A. Wargo, Macedon; Daniel L. Morris, Webster, all of N.Y.

[73] Assignee: Xerox Corporation, Stamford, Conn.

[21] Appl. No.: 626,848

[22] Filed: Dec. 13, 1990

[51] Int. Cl.[5] ..... G03G 15/09

[52] U.S. Cl. ..... 355/251; 355/215; 118/657

[58] Field of Search ..... 355/215, 245, 251, 253, 355/254, 255; 118/653-658

[56] References Cited

U.S. PATENT DOCUMENTS

| | | | |
|---|---|---|---|
| 4,377,334 | 3/1983 | Nishikawa | 355/3 |
| 4,583,112 | 4/1986 | Morano et al. | 355/3 |
| 4,666,282 | 5/1987 | Rowe . | |
| 4,800,411 | 1/1989 | Tanaka et al. | 355/3 |
| 4,963,930 | 10/1990 | Yoshimaru et al. | 355/215 |

FOREIGN PATENT DOCUMENTS

| | | | |
|---|---|---|---|
| 62-244072 | 10/1987 | Japan | 355/215 |
| 62-265681 | 11/1987 | Japan | 355/215 |

*Primary Examiner*—R. L. Moses

*Attorney, Agent, or Firm*—Kenyon & Kenyon

[57] ABSTRACT

A developer housing of an electrostatographic reproducing machine of the type using a magnet roll is provided with two openings in at least one of its side walls. The first of these holes is located at the high pressure portion of the housing, and the second of the holes is located at the low pressure end of the housing. The holes are interconnected by a pneumatic duct. A pressure differential is created as vane-like whiskers of developer are rotated about the magnet roll. The duct neutralizes these pressure differentials within the developer housing, thus preventing toner from being blown out of the developer housing.

12 Claims, 6 Drawing Sheets

NEUTRAL PRESSURE MAGNET ROLL TYPE DEVELOPING UNIT

BACKGROUND OF THE INVENTION

The decades since the advent of xerographic-type printing or copying have witnessed improvements to the quality of electrostatographic reproduction. Much of this improvement has concerned the recognition of problems associated with existing structure and their effective solution.

One such problem is extant in xerograhic printers of the type using a magnet roll type developing unit. In such a unit, a rotating sleeve within the developer housing revolves about a series of stationary magnets. The interplay of developer in the sump and lines of magnetic force causes developer to form a brush-like structure about the sleeve. The developer brush is used to form an image on a photoreceptive belt. While this is an effective approach to electrostatographic reproduction, it is not without problems. One such problem is the tendency of fine toner particles to be blown out from the developer housing into the remainder of the reproduction machine. The fine size of these particles makes them an invasive presence in an environment where such contamination can degrade the performance of the machine.

The immediate causative force behind this dispersal of toner particles from the developer housing is aerodynamic. The magnet roll developing unit creates a brush-like structure comprising whiskers of developer on the surface of a magnet roll sleeve rotating about the magnet roll. As the whiskers rotate with the sleeve and coact with the developer housing, they can act as a vane pump, creating regions of high and low pressure within the developer housing. The high pressure regions act to propel toner through small holes and gaps in the developer housing into the remainder of the reproduction machine.

Others in the field have attempted to solve this problem. U.S. Pat. No. 4,377,334 to Nishikawa shows the use of vent structure to reduce internal air pressure. U.S. Pat. No. 4,583,112 to Morano et al. shows the use of filtration structure to prevent toner particles from escaping into the machine. U.S. Pat. No. 4,800,411 to Tanaka et al. uses an air flow passage in a toner fiber limiting plate located within the developer housing to create localized air flows intended to reduce pressure differentials. The Tanaka patent is directed towards pressure differentials set up by counter-rotating magnet roll sleeve and developer drum. The pressure variations that it seeks to address are localized, involving adjacent regions of high and low pressure situated in the upper half of the developer unit.

There remains a need for a simple means for modifying the structure of a developer housing so as to prevent the creation of harmful air pressure differentials in general and air pressure differentials that arise across widely displaced regions within a developer housing.

SUMMARY OF THE INVENTION

The invention described herein provides an effective means for preventing toner particles from being blown out of the developer housing. A pair of pneumatic ducts is used to connect the high and low pressure regions on each side of the magnet roll developer. These ducts allow for the equalization of air pressure within the developer housing.

The above discussion is a summary of certain deficiencies in the prior art and features of the invention described herein. Other features and advantages of the invention will be apparent to those skilled in the art from the following detailed description of the invention.

DETAILED DESCRIPTION

Figure 1:
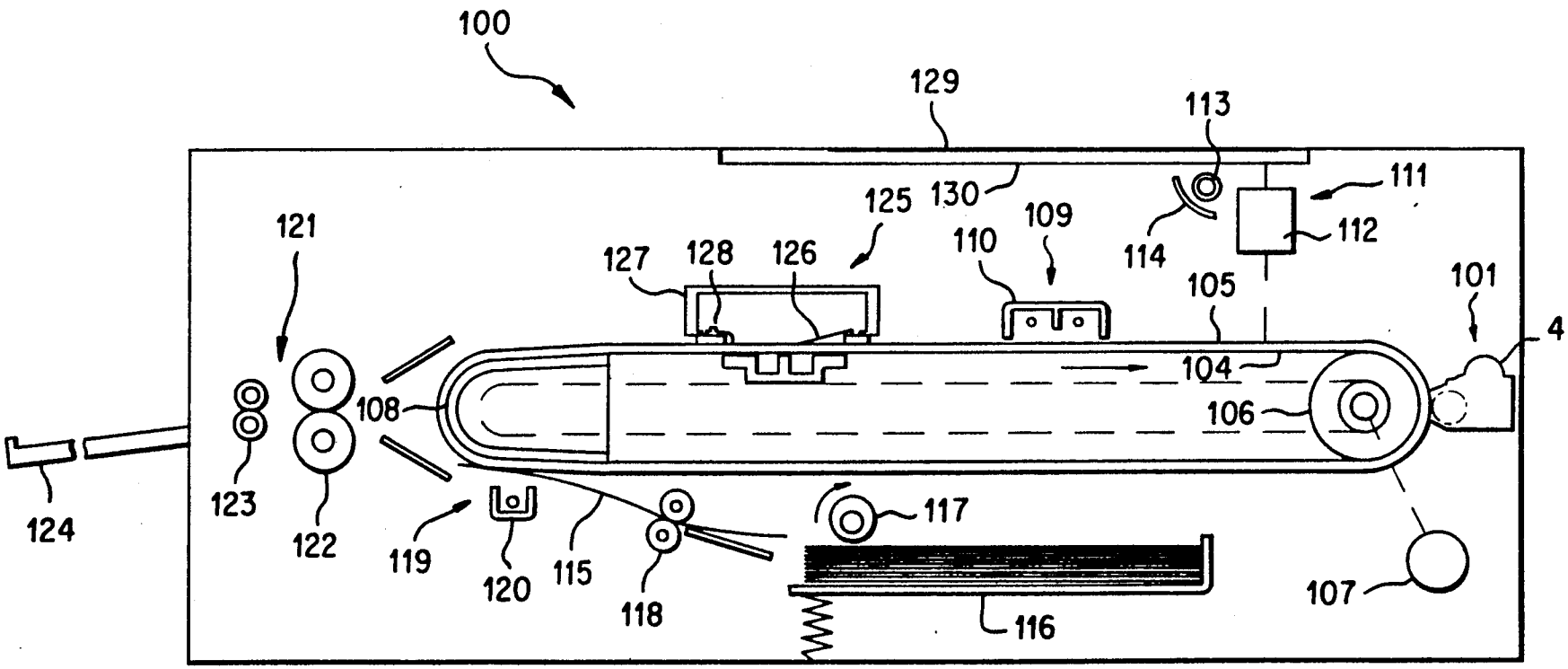
FIG. 1 is a schematic representation in cross section of an automatic electrostatographic printing machine with a developer housing constructed according to the principles of the invention.

An automatic electrostatographic reproducing machine 100 is illustrated in FIG. 1. The reproducing machine illustrated in FIG. 1 illustrates the components used to produce copies from an original document. Although the apparatus of the invention is particularly well adapted for use in automatic electrostatographic reproducing machines, it should be evident from the following description that it is not necessarily limited to the particular illustrated embodiment.

The reproducing machine 100 illustrated in FIG. 1 employs an image recording photoreceptor belt 104, the outer surface of which is coated with a suitable photoconductive material 105. The belt is mounted for revolution about driven transport roll 106, around belt tracking shoe 108, and travels in the direction indicated by the arrow on the inner run of the belt to bring the image-bearing surface of the belt past the plurality of xerographic processing stations. Suitable drive means such as motor 107 power and coordinate the motion of the various components.

Charging station 109 charges the belt uniformly with an electrostatic charge by placing the charge on the photoconductive surface with charge corotron 110 in a known manner. Exposure station 111 exposes the photoconductive surface 105 to the light image of the original input scene information. In this process, the charge is selectively dissipated in the light exposed regions to record the original input scene in the form of an electrostatic latent image. In the illustrated embodiment, the exposure station comprises a bundle of image transmitting fiber lenses 112, an illuminating lamp 113, and a reflector 114. Horizontal transport viewing platen 130 supports an original document 129 image side down and transports the original past the exposure station. (While this expedient is useful in compact reproducing machines, the present invention is not limited to such machines.) The speeds of the moving platen and photoconductive belt are synchronized to provide accurate reproduction of the original.

Developer station 101, described in greater detail below, applies developer to the photoconductive surface of the belt to render the latent image visible.

As shown in FIG. 1, sheets 115 of the final support material are supported in a stacked arrangement on elevated stack support tray 116. With the stack at its elevated position, the sheet separator segmented feed rolls 117 feed individual sheets from the stack to the registration pinch roll pair 118. The pinch roll pair feeds the sheets to the transfer station 119. The transfer station comprises a transfer corotron 120 that transfers the toner image from the photoreceptor belt 104 to the sheet. Fixing station 121 comprises roll fuser 122 which fixes a transferred toner image to the sheet. Output rolls 123 advance finished sheets to sheet stacking tray 124.

Residual toner remaining on the photoreceptor belt 104 is removed at cleaning station 125. In the illustrated embodiment, the cleaning station comprises a cleaning housing 127 containing a cleaning blade 126 in scraping contact with the outer periphery of the belt and a cleaning seal 128 placed at the upstream opening of the cleaning housing.

The invention will be described in conjunction with the developer station 101 illustrated in detail in FIGS. 2–6.

Figure 2:
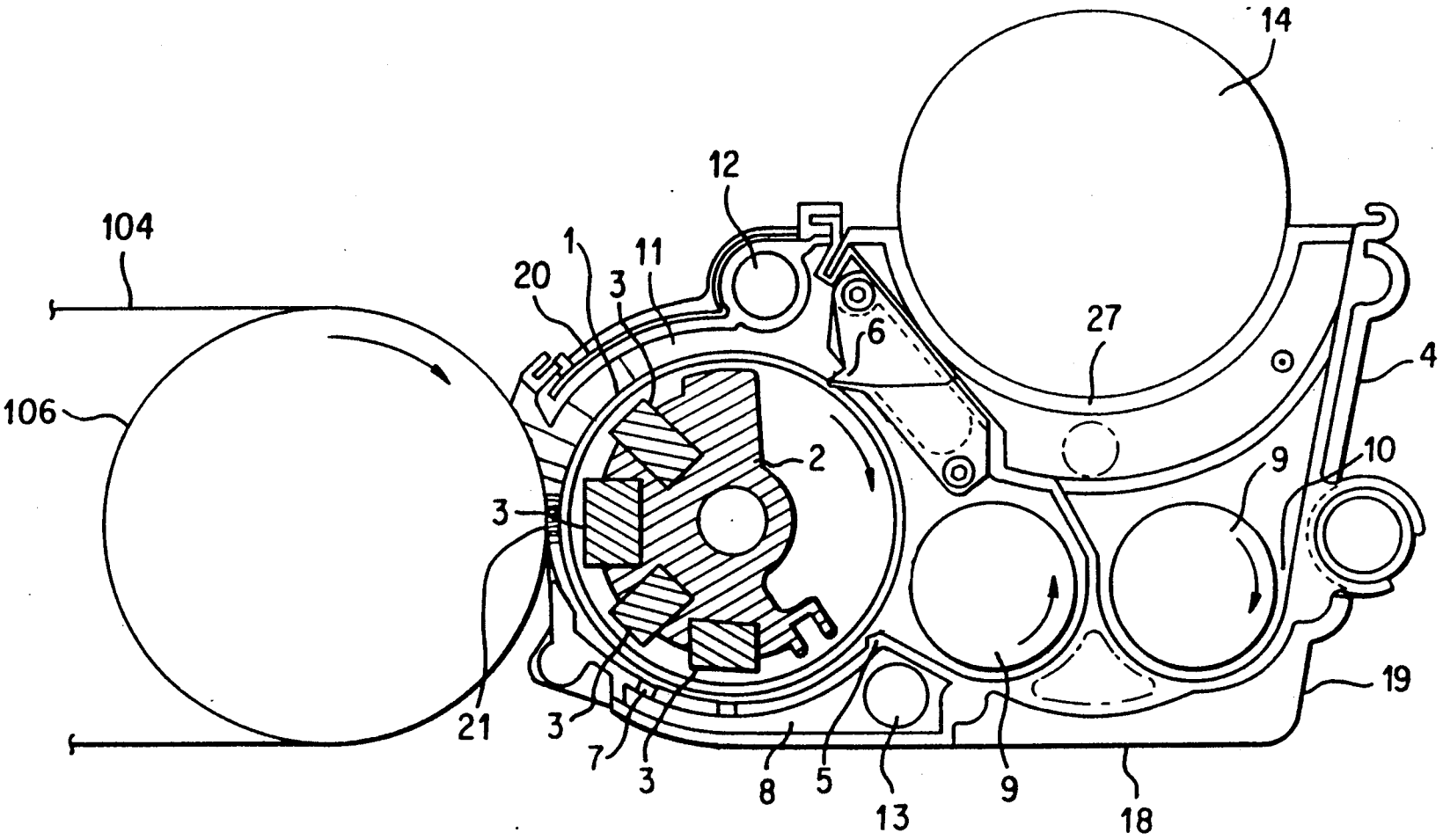
FIG. 2 is a schematic representation in cross section of the developer housing constructed according to the principles of the invention.

The developer housing 4 contains the magnet roll tube, magnet roll sleeve, developer sump, and toner supply. The housing is typically formed as an aluminum extrusion. FIG. 2 illustrates a cross sectional view of the developer station. A pair of side walls 17 is spaced apart by a generally flat bottom wall 18 and a rear wall 19. The upper portion of the housing 20 is curved at 27 so as to receive a toner canister 14 in the conventional manner. The upper portion 20 and lower wall 18 define an opening 21 at the front portion of the housing. This gap is of sufficient width to allow for the partial protrusion of the magnet roll sleeve.

Developer is formed within the sump region 10 of the developer housing by combining carrier particles with toner. The carrier is recycled in use, and is stored in the sump. The toner, which is expended in the operation of the machine, is supplied to the sump by means of a toner canister 14 in any conventional manner known to the art.

The mixing of the toner particles with magnetic carrier particles in the sump may be accomplished by means of a pair of augers 9 running substantially along the width of the developer station. The augers also serve to deliver developer to the surface of a tube-like magnet roll sleeve 1. The amount of developer applied to the surface of the magnet roll sleeve is controlled by a doctor blade 5.

The magnet roll sleeve is a tube constructed of a non-magnetic material, e.g. aluminum. The tube may be provided with a corrugated surface for better receiving the developer particles. The sleeve, which may be connected by journal bearings to the developer housing, is rotated (a motor may be used for this purpose) about a stationary assembly of magnets 3 forming a magnet roll 2, as is conventional in this art. These magnets 3 of the magnet roll attract the developer to the surface of the sleeve for further transport with the rotating sleeve. A portion of the tube extends into the front opening of the developer housing, where its forward surface is in close proximity to the photoreceptor belt. The developer is then brought into contact with the electrostatic latent image recorded on the photoconductive surface of photoreceptor belt 104. The portion of developer that is returned to the developer housing falls off the rotating magnet roll sleeve when the sleeve is rotated past the magnets. Any remaining developer is further removed by the scraping action of a doctor blade 6. The magnet roll sleeve is illustrated as rotating in the same clockwise sense as the photoreceptive belt, but this need not be the case.

The magnetic attraction between the magnets 3 and the developer causes the developer to be arrayed along the lines of magnetic force associated with the magnets. This creates vanes of a brush-like tuft of developer along the rotating magnet roll sleeve 1. As the rotating tuft is swept along the photoreceptive belt 104, some of the developer is attracted to the latent image formed thereon by forces of electrical attraction. The developer particles that move from the tuft to the belt form a toner image on the belt.

Figure 6:
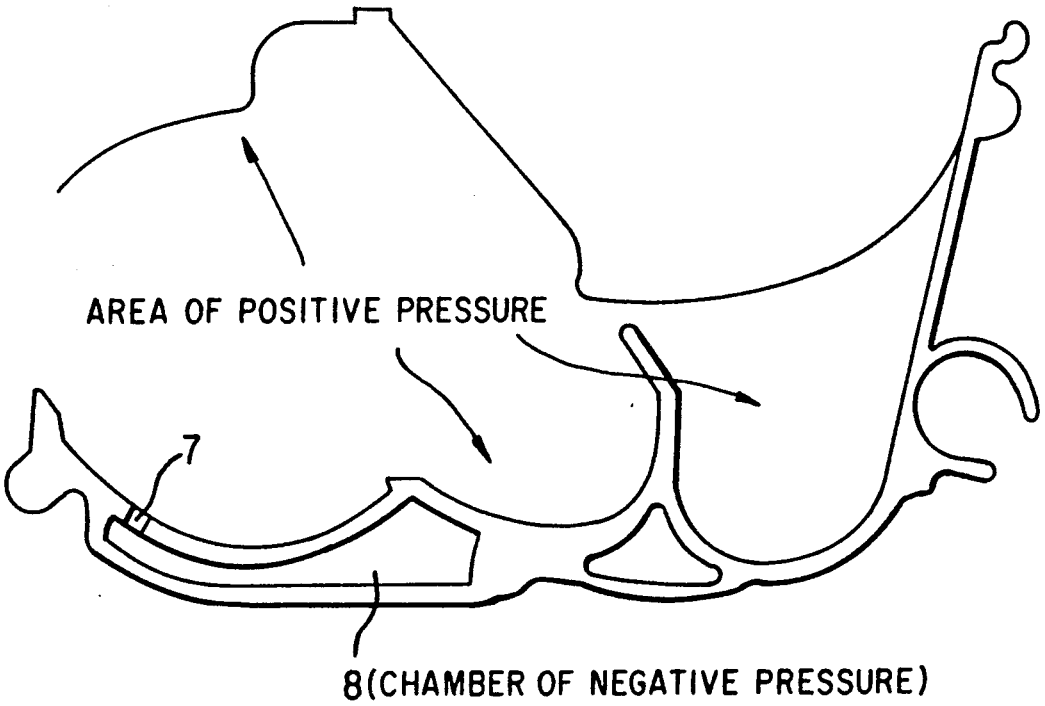
FIG. 6 is a schematic representation in cross section of the pressure distribution about the developer housing.

The remainder of the developer, now aligned as vanes along lines of magnetic force about the magnet roll, continues to move in the clockwise sense back into the developer housing. The front portion of the upper housing wall 20 causes these vanes to collapse, which causes the air trapped between the vanes of developer to undergo compression as it is swept into the developer housing. Consequently, region 11 within the housing develops a positive pressure differential with respect to the lower pressure region at the bottom of the roll. (FIG. 6 illustrates a typical pattern of high and low pressure regions within the developer housing.)

Left unchecked, the pump-like action of the vanes of developer tend to create a pressure differential that aerodynamically agitates the developer within the housing, causing some of it to be blown out of any small holes or crevices that may exist within the developer housing and into the remainder of the reproduction machine.

The present invention prevents the creation of such air currents by providing one or both sides of the developer housing with a duct connecting the high pressure portion 11 within the housing with the low pressure portion of the housing. A negative pressure plenum 8 is provided in the extrusion forming the developer housing 4. This plenum is connected by a passageway 7 (which can comprise a series of openings) to the low pressure region about the magnet roll. The negative pressure plenum is provided with an opening 13 on the lateral side walls of the developer housing to provide a connection to a pressure equalization duct 15 (see FIGS. 3–5). This duct is connected via a similar opening 12 to the high pressure region of the developer housing, and is disposed externally to the developer housing.

Figure 3:
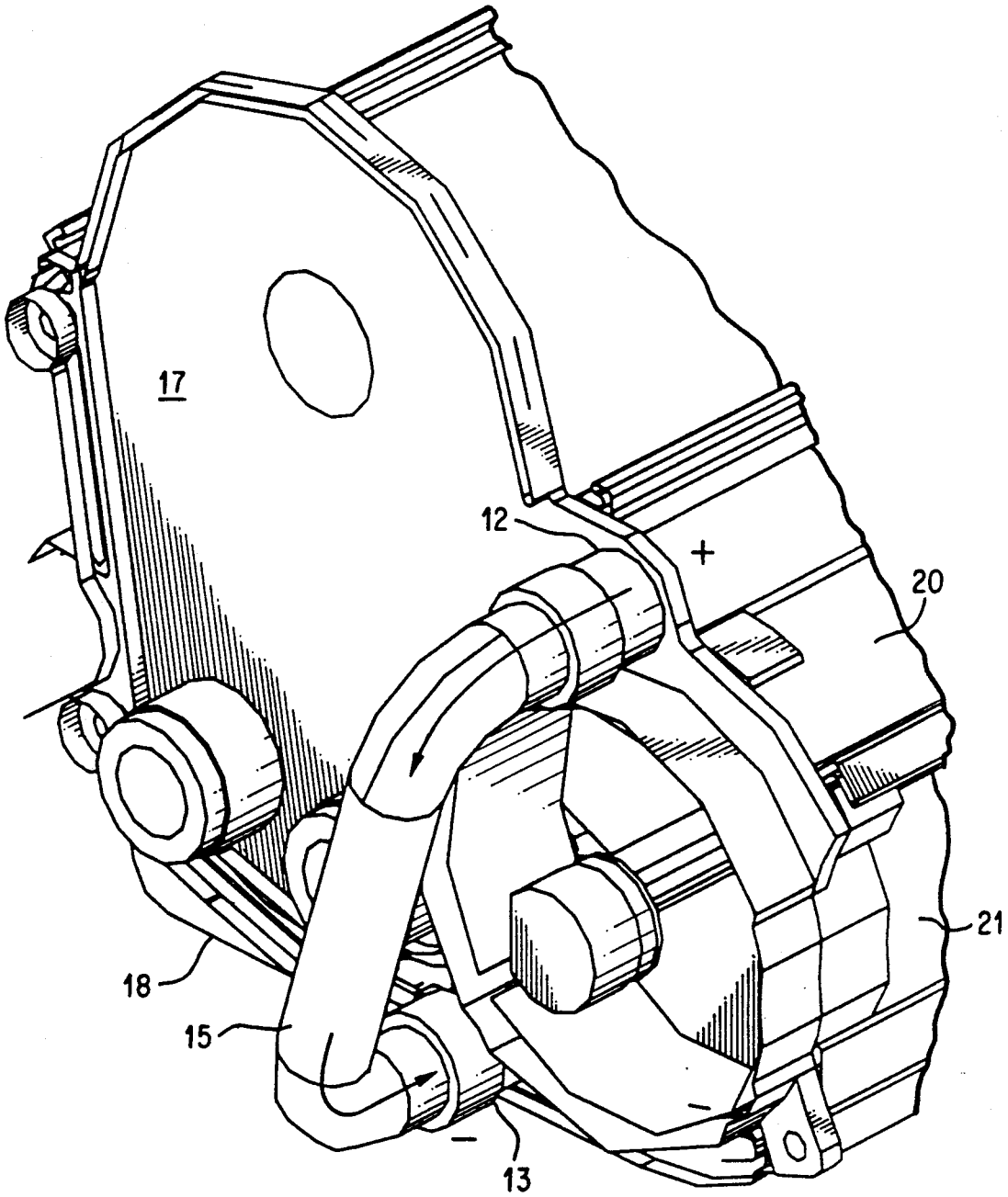
FIG. 3 is a perspective view of one side of the developer housing and pneumatic ducts.
Figure 4:
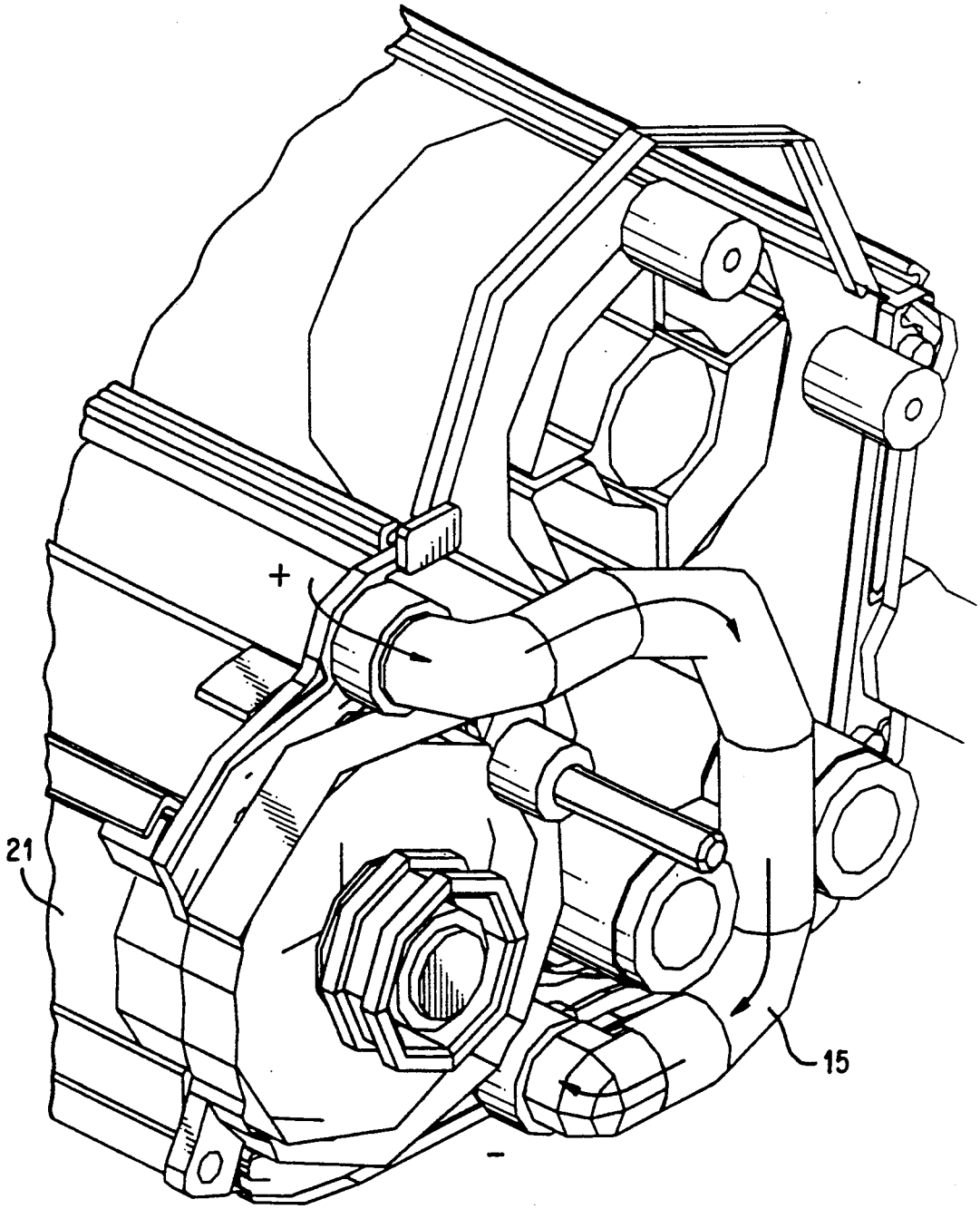
FIG. 4 is a perspective view of another side of the developer housing and pneumatic ducts.
Figure 5:
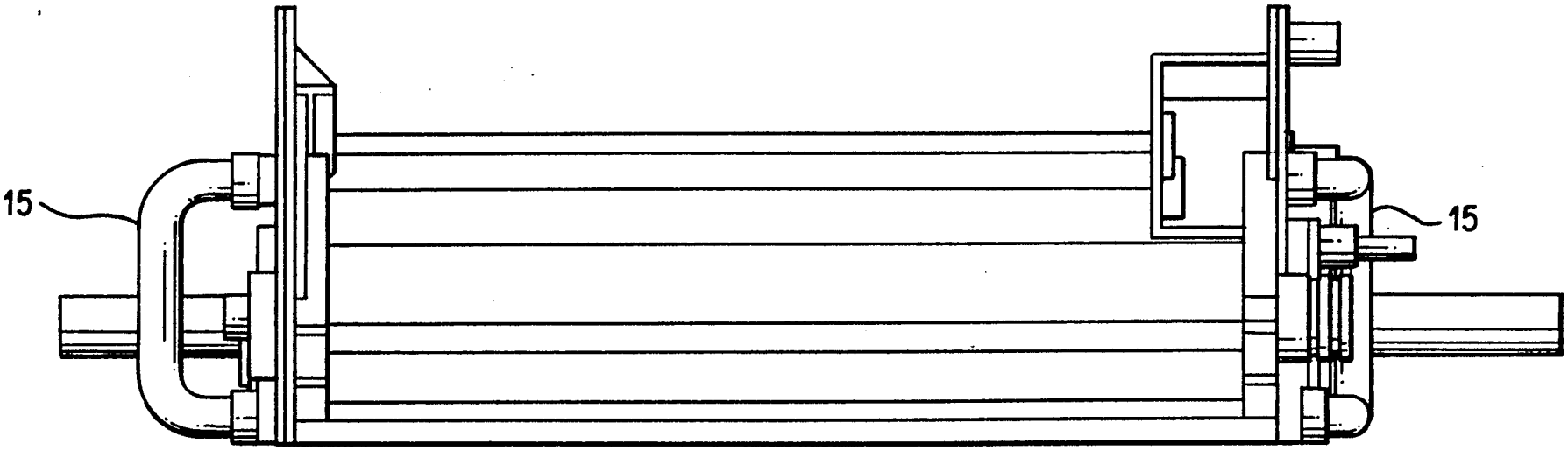
FIG. 5 is a front plan view of the developer housing.

This pressure equalizing ducting is provided on both sides of the developer housing, thereby neutralizing pressure differentials within the housing that would otherwise arise due to the vane-pump action of the developer particles. FIGS. 3–5 illustrate one possible arrangement of pressure-equalizing ducting. The particular ducting employed would be a function of the developer housing geometry and available space.

While the invention has been described with reference to a specific embodiment, it will be apparent to those skilled in the art that many alternatives, modifications, and variations may be made. Accordingly, it is intended to embrace all such alternatives and modifications that may fall within the spirit and scope of the appended claims.

What is claimed is:

1. A housing for a magnet roll developing unit, comprising:

side walls for supporting a magnet roll;

first and second apertures on at least one side wall; and a duct for connecting said first and second apertures to each other, thereby placing them in mutual pneumatic communication with one another.

2. The device of claim 1, further comprising a plenum that defines a low pressure region when the device is in use.

3. The device of claim 2, wherein the plenum is in pneumatic communication with a more inwardly situated region within the housing by means of an orifice.

4. The device of claim 1, wherein first and second apertures are provided to each of the side walls of the housing, and first and second pneumatic ducts are provided for linking the first aperture on each side to the second aperture on that side.

5. The device of claim 1, wherein the housing is formed from metal as an extrusion.

6. A neutral pressure magnet roll developing unit, comprising:

a. a substantially enclosed and rigid housing having a pair of side walls, a bottom wall, and a front portion with an opening therein, said housing having an upper half and a lower half;

b. a cylindrical tube extending between said side walls and being journaled thereon for rotation with respect to the side walls;

c. means for rotating said cylindrical tube;

d. a plurality of magnets located within the cylindrical tube;

e. a plenum located in the lower half of the housing, said plenum being connected to the remainder of the housing by an orifice in the plenum wall, and f. a pair of orifices on at least one of the side walls of the developer housing, and a pneumatic duct connecting said orifices to one another.

7. The device of claim 6, wherein one of the orifices on each side of the developer housing is in that portion of the housing that defines the plenum.

8. The device of claim 6, wherein the duct is disposed external to the housing.

9. The device of claim 6, wherein the housing is formed as a metal extrusion.

10. The device of claim 6, wherein the cylindrical tube is formed of aluminum.

11. The device of claim 10, wherein the tube has a corrugated surface.

12. A developing unit for use with electrostatographic reproduction systems, comprising:

a. a substantially enclosed and rigid housing having a pair of side walls, a bottom wall, and a front portion with an opening therein, said housing having an upper half and a lower half;

b. a cylindrical magnet roll sleeve extending between said side walls and being connected thereto for rotation with respect to the side walls;

c. a plurality of magnets spaced apart from and circumferentially arrayed about the inner wall of the magnet roll sleeve;

d. means for rotating the magnet roll sleeve about the magnets;

e. a region within said housing for receiving toner;

f. means for supplying said toner to the surface of the magnet roll sleeve;

g. a blade formed within the housing and extending substantially across the entire width of the developer housing, said blade being spaced from the outer surface of the magnet roll sleeve so as to control the amount of toner that adheres to the magnet roll sleeve;

h. a plenum located in the lower half of the housing, said plenum being connected to the remainder of the housing by an orifice in the plenum wall, and i. a pair of orifices on at least one of the side walls of the developer housing, and a pneumatic duct connecting said orifices to one another, whereby the rotation of the magnet roll sleeve about the magnets causes the formation of vane-like projections of developer on said sleeve, and said vanes coact with the housing to impart a pumping action to the interior of said housing so as to create a first high pressure region in the upper portion of the housing and a second low pressure region in the lower portion of the housing and its adjacent plenum, said high and low pressure regions being connected to one another via the pneumatic ducts so as to equalize pressure within the housing.

* * * * *